US005413345A

United States Patent [19]

Nauck

[11] Patent Number: 5,413,345

[45] Date of Patent: May 9, 1995

[54] GOLF SHOT TRACKING AND ANALYSIS SYSTEM

[76] Inventor: George S. Nauck, 2226 Spanish Moss Dr., Jacksonville, Fla. 32246

[21] Appl. No.: 19,911

[22] Filed: Feb. 19, 1993

[51] Int. Cl.[6] ..... G06F 15/44

[52] U.S. Cl. ..... 273/185 R; 273/35 R; 273/183.1; 434/252; 368/157; 368/169

[58] Field of Search ..... 273/176 R, 32 R, 35 R, 273/35 B, 181 R, 185 A, 185 B, 183.1, 185 R; 434/252; 358/125, 93

[56] References Cited

U.S. PATENT DOCUMENTS

| | | | |
|---|---|---|---|
| 4,005,261 | 1/1977 | Sato et al. | 273/183.1 |
| 4,158,853 | 6/1979 | Sullivan et al. | 358/93 |
| 4,160,942 | 7/1979 | Lynch et al. | 273/183.1 X |
| 4,696,474 | 9/1987 | Tegart | 273/176 A |
| 4,893,182 | 1/1990 | Gautraud et al. | 358/105 |
| 4,910,677 | 3/1990 | Remedio et al. | 364/410 |
| 4,934,705 | 6/1990 | Shirley | 273/176 R |
| 5,102,140 | 4/1992 | Vincent | 273/176 A |
| 5,111,410 | 5/1992 | Nakayama et al. | 273/183 R |
| 5,138,322 | 8/1992 | Nuttall | 342/126 |
| 5,146,577 | 9/1992 | Yamrom et al. | 359/161 |
| 5,160,839 | 11/1992 | Nishiyama et al. | 250/222.1 |
| 5,163,683 | 11/1992 | Oswald | 273/176 A |
| 5,184,295 | 2/1993 | Mann | 364/410 |
| 5,210,603 | 5/1993 | Sabin | 358/93 |
| 5,226,660 | 7/1993 | Curchod | 273/185 B |

*Primary Examiner*—Vincent Millin
*Assistant Examiner*—Kerry Owens
*Attorney, Agent, or Firm*—John C. Garvin, Jr.; James E. Staudt

[57] ABSTRACT

A system utilizing an array of high speed video cameras with image processors coupled to data microprocessors, data memory devices, video monitors, control terminals, printout devices, and related hardware and software. The system functions to identify, track, display and record all or selected portions of the path of one or more golf balls from the time each ball is struck, or after it is in flight, until it reaches its final point of rest. The recorded tracking information may be displayed in selected forms such as video or audio replays of the actual golf shot or selected portions thereof, or by printed data in character or graphic form. The tracking information may be reviewed for detailed study of all or portions of the track of the golf shot as well as the final resting place of the ball with respect to the intended target of the shot. If desired, all or selected portions of the track of the recorded golf shot may be compared to like portions of selected previous golf shots made by the golfer, as well as to selected golf shots may by other golfers and previously entered into the memory of the system. The golf shot may also be compared to selected parameters which one may desire for comparison to the recorded information relating to the golf shot.

10 Claims, 2 Drawing Sheets

GOLF SHOT TRACKING AND ANALYSIS SYSTEM

BACKGROUND OF THE INVENTION

1. Field of the Invention The present invention relates to a system for continuous, three dimensional tracking and for analyzing and recording the entire or selected portions of the path of one or more golf shots as each golf ball which is struck proceeds from the point of impact of the shot to a point to rest.

Tracking may begin from the time each ball is impacted with a golf club or if desired after the ball is in flight, and continues until the ball comes to rest. Analysis of each golf shot encompasses all operations of the system other than tracking the shot. The track for each ball is recorded and may be displayed as desired. The invention is used to compare a golfer's performance in making golf shots to previous golf shots made by the golfer or by other golfers. This system thus provides the basis for a new competitive game called TARGET GOLF wherein the performance of golfers may be measured and compared with a degree of speed, completeness and accuracy heretofore unachievable. The system is also used as a teaching aid for golfers, as well as a tool for evaluation of the performance of golfing equipment.

2. Description of Related Art

In the past, golf games, including golf shot monitoring apparatuses, have attempted to evaluate the performance of golf shots. The purpose of these games was to provide the distance and direction of a golf shot and the area in which the golf ball landed. Previous means to achieve these objectives have included the use of radar, mechanical and electronic switching, sound detection and television.

Examples of such related prior art are found in the following U.S. Pat. No. 4,006,907 to Heffley; U.S. Pat. No. 4,673,183 to Trahan; U.S. Pat. No. 4,696,474 to Tegart; and 4,898,388 to Beard.

The Heffley patent utilizes a complex arrangement of mechanical switches and electronics to register the radial distances from a target that a golf ball lands. This is accomplished by detecting impact proximity to sensitized targets. This device has no provision to determine the final position of the ball as it rolls beyond its point of impact, nor can it detect the directional location of either the point of impact or the final resting place of the ball with respect to the target.

The Trahan patent utilizes a series of ground surveillance radar units to determine approximately how far a golf ball has travelled from its point of origin. This device provides no accurate information as to the directional path of the ball.

The Tegart patent utilizes an arrangement of closed circuit television cameras along a driving range to allow golfers to review their shots. The golfer must differentiate the ball from others being hit on the range and is left to estimate the distance the ball has traveled and final position by viewing a television monitor.

The Beard patent utilizes an array of vibration sensors distributed in a predetermined pattern in a target area, each of which generates a signal indicative of the area of impact of a golf ball. This system cannot differentiate between the source of balls entering the target area, determine the final position of a ball, nor determine the path of the ball through the air.

SUMMARY OF THE INVENTION

The present invention is a system utilizing an array of high speed video cameras with image processors coupled to data microprocessors, data memory devices, video monitors, control terminals, printout devices, and related hardware and software. The system functions to identify, track, display and record all or selected portions of the path of one or more golf balls from the time each ball is struck, or after it is in flight, until it reaches its final point of rest. It is noted that as used herein the term track is defined as the location in three dimensional of the path of an object as it travels through space. The recorded tracking information may be displayed in selected forms such as video or audio replays of the actual golf shot or selected portions thereof, or by printed data in character or graphic form. The tracking information may be reviewed for detailed study of all or portions of the track of the golf shot as well as the final resting place of the ball with respect to the intended target of the shot. If desired, all or selected portions of the track of the recorded golf shot may be compared to like portions of selected previous golf shots made by the golfer, as well as to selected golf shots made by other golfers and previously entered into the memory of the system. The golf shot may also be compared to selected parameters which one may desire for comparison to the recorded information relating to the golf shot.

The system measures the desired parameters of each shot including line (distance left or right of a line from the point of original impact through the target), distance (distance short or long of the target) as well as the trajectory of the ball in flight. Selected data generated by the video cameras may be displayed in real time and is also accumulated and analyzed by computer processor equipment. The data is then stored for reproduction in human readable form. Thus, information is provided for review of the track of the ball as it is displayed by a video monitor or for review of a numerical or graphical print out of data relating to the golf shot. Additionally, the system provides selected statistical data for comparison of the attributes of a selected group of golf shots to those of any other recorded group of golf shots.

The system is used in support of a new game called TARGET GOLF in which statistically calculated golf shot accuracy is fed back immediately to a golfer, enabling competition between golfers. In addition, the invention will be used for evaluating and verifying the performance of golfers in golf programs, golf teaching schools, and clinics. Other applications include the testing and evaluation of golf equipment such as golf balls and golf clubs.

Accordingly, it is an object of the invention to provide a golf ball tracking system which provides a means for the accurate reproduction of the aspects of a golf shot which are necessary to evaluate the quality of the shot.

Another object of the invention is to overcome the shortcomings of prior art devices which seek to provide information necessary to evaluate the quality of a golf shot.

These and other objects of the invention will be apparent to one skilled in the art from the following detailed description of specific embodiments thereof.

DESCRIPTION OF THE PREFERRED EMBODIMENT

The golf ball tracking system which is the subject of this invention includes a network of imaging, computing, and data storage and retrieval equipment. This network is linked to control and display terminals. The purpose of the system is to accurately measure the performance of one or more golfers in hitting golf balls directed at predetermined targets and to measure the results of golf machines hitting balls at predetermined settings. The system will provide accurate measurement of golf shots as well as statistically treated data of accuracy and consistency. Thus, information is provided relating to golf shots which travel great distances down-range, where a golfer's visual interpretation of golf shot performance would be approximate and subjective. The system may also be used in short shot applications such as pitching, chipping, sand saves, and putting.

Figure 1:
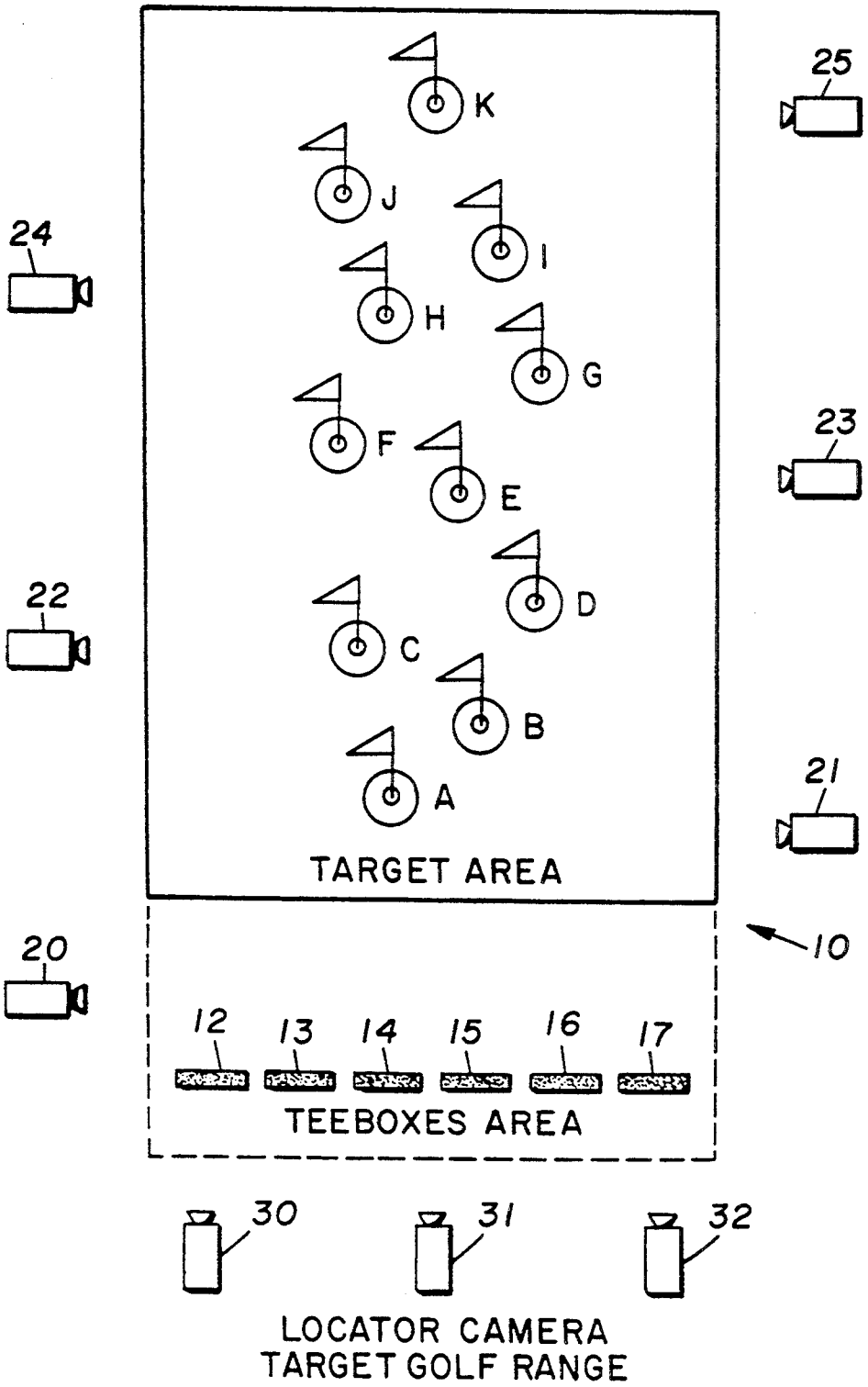
FIG. 1 is a plan view of a golfing range illustrating teeboxes, various golf targets and a typical array of video cameras utilized in tracking golf balls being driven from the teeboxes to the various targets.

Referring now to FIG. 1 of the drawings, it will be seen that a golf driving range is illustrated generally by the numeral 10. The range includes a teebox area having individual teeboxes 12 through 17 and a target area having individual golf greens A through K. The range 10 is typically approximately 100 yards in width and approximately 300 yards in length so as to accommodate the golf shots of most golfers. Range cameras 20 through 25 are located three on either side of the golf driving range while locator cameras 30, 31 and 32 are located behind the teebox area. It should be noted however that locator cameras may be placed at any convenient location from which a golf shot can be viewed. Each of the cameras 20 through 25 and 30 through 32 are strategically located to form a camera array which is designed to provide an efficient viewing coverage of the range 10, while also providing a predetermined overlapping field of view which permits simultaneous viewing of a golf ball by more than one camera. While this overlapping field of view is not required, it simplifies the tracking as a golf ball passes from the field of view of one camera to the next. It is pointed out that locator cameras 30, 31 and 32 as well as range cameras 20 and 21 may be positioned for viewing the golf balls as they are struck, or after they are in flight. The number of cameras required is of course dependent upon the size of the range. The system may require only a single range camera used in conjunction with a single locator camera for a small range such as may be utilized for short golf shots such as chips, pitches or putts. The range and locator cameras may be alike physically and electronically, however, in typical applications the locator camera's view the golf shot as it leaves the tee area, while the range camera's view the shot from a generally perpendicular position down range. The images from the cameras are fed into appropriate electronic equipment which relates the image of a golf ball to a position in space.

Figure 2:
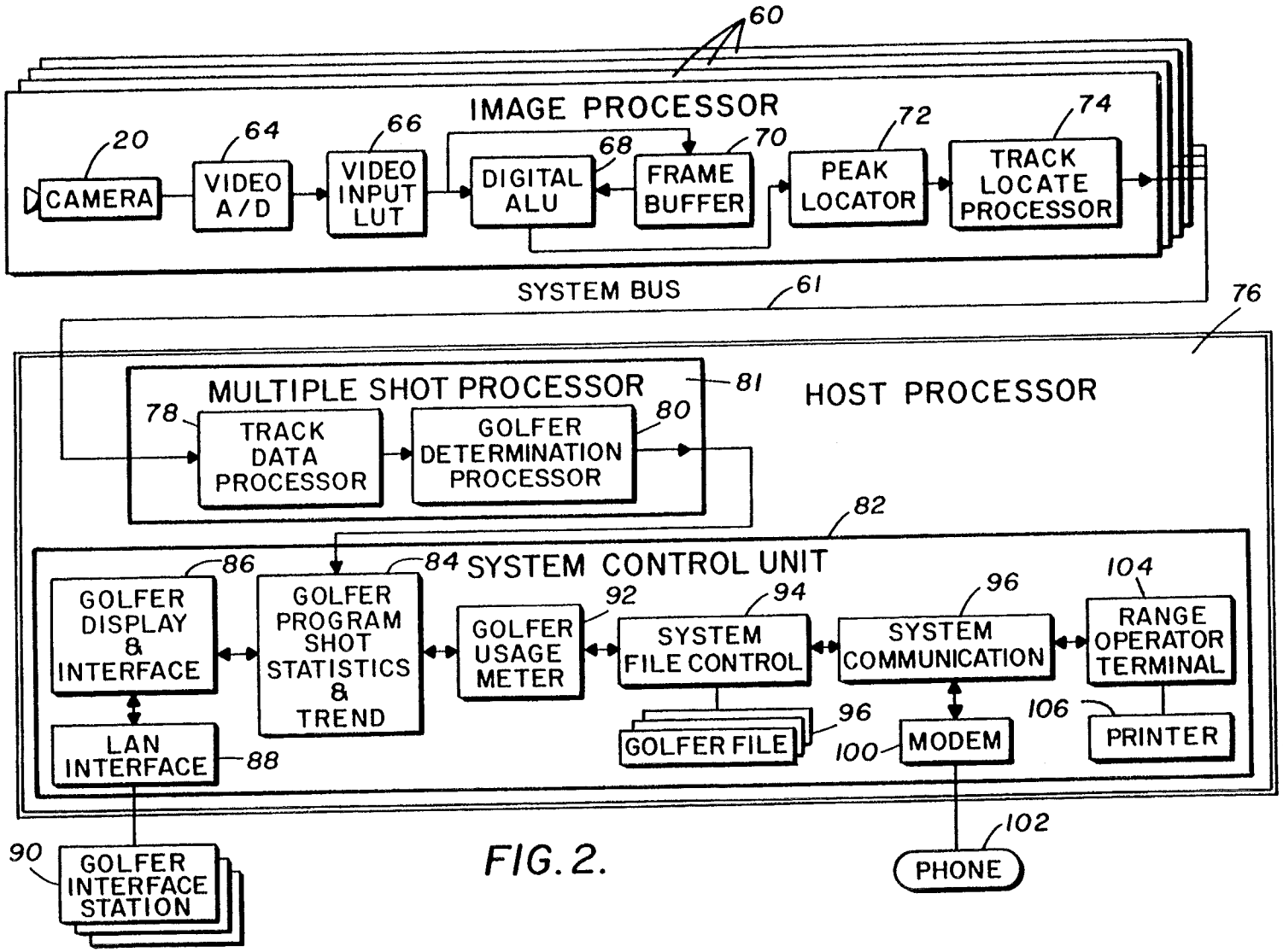
FIG. 2 is a block diagram illustrating the components of the golf ball tracking system.

Referring now to FIG. 2, a block diagram is provided to illustrate the components utilized by the golf ball tracking system. The function of each of the illustrated components of the system will be described hereinafter, however it is to be understood that it is within the skill of the art to combine or to separate certain of the herein described functions and to accomplish such functions by the use of a variety of available components. As illustrated in FIG. 2, two components, an image processor 60 and a host processor 76 encompass the basic electronics of the invention. The host processor 76 includes a multiple shot processor 81 and a system control unit 82. An image processor 60 is provided for each of the multiple cameras 20 through 25 and 30 through 32 as illustrated in FIG. 1. It is noted that camera 20 (and all cameras utilized in the system) serves not only as a camera but includes electronic image processing equipment as well. Each camera is a high speed video camera having a retina of the CCD (charge-coupled-device) array configuration and is therefore capable of providing signals in response to the image projected thereupon. The CCD array provides signals which vary in accordance with the intensity of light which strikes it in any given area. This permits the system to react precisely to the varying shades of light of an image projected upon the array. This feature is referred to as grey-scale processing. Such camera, computer and processing equipment is well known in the art and is therefore not illustrated in detail in the drawings. It is pointed out that when two or more cameras have the same golf ball in view, the ball's precise location in space may be determined by intersection and trigonometry, and the path of the ball through space may be tracked. The software which includes the mathematics and programming for this operation is well within the state of the art. This software application allows precise determination of ball locations whether in flight or on the ground. Alternative means encompassing calculation of projectile trajectory may also be used. "Mapping" of the ground topography in computer memory allows precise location of points of intersection of the camera azimuth and the ground plane to locate the ball or ball impact points as well as the location of the targets. Specially designed circuitry and software allow the processors of this system to process imagery data so as to determine from the location and track of the ball, the area from which the golf shot originated. In this way the golfer who originated the shot may be identified. The video signals provided by the camera 20 are converted from analog to digital by an A/D converter 64 and are then fed to a digital ALU (arithmetic logic unit) 68 and to the frame buffer 70 through a video input LUT (look up table) which adjusts the data passing therethrough to provide useable signals relating to grey scale images. The digital ALU 68 subtracts a previous image supplied by the frame buffer 70 from a current image to determine change in the image over the time between reception of the images, and passes this information to a peak locator 72 which compares the differences between successive images to identify golf balls in motion and to find the coordinates of a golf ball being tracked. The track locate processor 74 receives the output of the peak locator 72 and combines the image and ball coordinates over time into a golf ball track record for the image processor 60. The golf ball track records support the various types of images, including flight images and landing images. Because multiple balls may be viewed simultaneously by each image processor, multiple golf ball track records may be developed simultaneously. These track records support some or all of the tracking elements viewed and recorded by the golf ball tracking system. Depending upon which image processor is concerned and the nature of the golf shot, the viewed and recorded elements include: the flight record of each ball, the landing record of each ball, the track data, the projected ball source location relating the data to a particular golfer, the projected ball source vector relating a section of the golf ball track to a previous section of the track, projected destination vector relating a section of the golf ball track to a future section of the track, impact location, and final lay location relating the end of the ball roll-out to a particular golf ball track record. As shown in FIG. 2, the information generated by the image processors 60 is passed through a bus 61 to a host processor 76 which includes a multiple shot processor 81 and a system control unit 82. The multiple shot processor includes a track data processor 78 and a golfer determination processor 80. The multiple shot processor 81 receives the tracking data from one or more of the image processors 60. The function of the multiple shot processor 81 is to relate all data interconnecting the different camera views and flight and land records, producing individual golf shot performance data which provides the complete history of each golf shot from the first detection to final lay. This golf shot performance data may include a reconstruction of each shot that includes height, distance, trajectory, impact location, final lay location and the relationship of the impact and/or final lay locations to a selected target location based on coordinates of each target and each ball. The track data processor 78 contributes to the function of the multiple shot processor 81 by processing data from the image processors to create the golf shot performance records, while the golfer determination processor 80 combines the golf shot performance data with the source tee and the individual golfer, thus providing assignment of golf shot performance records to the appropriate golfers. As further illustrated by the drawing, data from the multiple shot processor 81 is directed to the system control unit 82, and more specifically to block 84 which provides golfer program shot statistics and trend. The components within block 84 provide computations and organization of golf shot performance data. These components also compute and transmit a resultant output to a golfer display and interface 86, which relates appropriate data to a golfer's individual shots and scoring data in accordance with selections made by the golfer, and direct appropriate data back through the system for storage. The golfer display and interface 86 converts golf shot performance data into various selected display arrangements for the golfer, and provides an interface for a golfer interface station 90 through a LAN (local area network) 88. The LAN 88 provides communication between multiple golfer interface stations 90 and the golfer display and interface 86. The golfer interface station 90 which is a part of the control system 82 is illustrated as being outside the system control block because it is typically located at a remote tee box. The golfer interface station provides the golfer with system control for selection of targets, identification of data sets, choice of display, mode of play such as individual or multiple player, etc., and provides feedback by display of selected data format on a video monitor. A golfer usage meter 92 accepts and provides data relating to the usage of the system by individual golfers. The system file control 94 provides assignment of data to appropriate data files in computer storage, manages system files and individual data files, provides system control, provides golfer file access, and access to historical data and reference sources for performance comparison. In addition, the system file control 94 provides data for hard copy printouts, system usage information, billing information and other information needed for administrative purposes. Golfer information is stored as indicated by equipment within files 96. This equipment provides storage for individual golfer's golf shot performance data and sets of data, and other information as may be desired. System communication equipment within block 98 provides communication with the range operator and external facilities for importing and exporting data and information, for printouts of hard copy, and for transfer of files to and from removable disk storage media. The range operator terminal 104 provides access for the system or range operator, with facility for monitoring system activity and usage, system control, and for the production of hard copy printouts of selected data. The modem 100 allows interface for transfer of data to and from the system by telephone 102 through telephone lines or other electronic data transfer means. The printer 106 provides the actual production of hard copy information in a selected form as desired. If desired, printers for hard copies may be located at other points such as golfer interface stations at the teebox.

From the above description, it is apparent that this invention provides a "smart" system, whereby balls in flight may be differentiated and tracked simultaneously without interference with each other, even when intersecting a common azimuth from a camera. This is accomplished by either back calculating the prior path of each ball based on a range of successive data points, or prediction of future path of each ball by the same method, or both, thereby enabling the system to distinguish between bails passing in front of the camera in conjunction before breaking out again into independent trajectories. By this method, it is not necessary for a camera to "see" a ball on the tee in order to establish specific teebox origin of the balls in flight, although cameras may be positioned to view balls on the tee when preferred. As a result of this "smart" system, there is no limit to the number of teeboxes or targets that may be monitored simultaneously, provided that sufficient cameras and computational capacity are provided. This provides a distinct advantage over all previous inventions for measuring and reporting golf balls hit to a target wherein physical isolation is required to allow accurate identification of a single golfer's performance or where the golfer himself must attempt to discern which performance is his among other participants on the facility.

Golf equipment designers and manufacturers use a mechanical robotic golfer to hit balls at a test range to evaluate performance of balls and clubs when hit with precisely controlled and duplicatable conditions. By measuring the results of the ball such as distance, roll, scatter, etc. and computing statistical results, the ball or equipment is judged. Prior to the present invention such measurements must be done manually by making direct measurements in the field or by making measurements from video after the fact. In any case, use of manual measurements to obtain accurate data depicting a golf ball in flight are difficult, and require a great deal of time and effort. The present invention improves this process, providing the capability for immediate measurement, recording, and statistical analysis for all aspects of the ball's flight, bounce and roll.

In operation, a golfer interface station is typically located at a teebox, one for each teebox to be included in the system. The golfer chooses his target from among all of those which are in the system (targets A through K, FIG. 1) and enters it at the video and control display. He may also enter a personal identification for adding his current data to his historical file in data storage. He may enter other items of interest such as club selection, weather and ground conditions, etc., which he wishes to make a matter of record for the data set. The data display is thus "zeroed" to begin an accumulation of data to be measured, statistically analyzed, displayed, and stored for present and future reference. It is understood that tracking of a golf shot may begin as the ball is struck or after the golf ball is in flight. This starting point of the tracking is dependent upon the most convenient location of the locator cameras 30 through 32. As a golf shot proceeds down range, it is "handed off" as it passes from the field of view of one camera to the next. Thus, appropriate processors will pick up and track a ball leaving the teebox area. As the ball moves down range, its image will be passed to an appropriate processor which is farther down range. Accordingly, it will be understood that each camera and its associated processors will in turn track the golf ball until it is necessary to pass it off to the next camera and its associated processors. This process is repeated until the ball strikes the ground and finishes its roll-out. The software programming and trajectory computations also allow the electronics system to anticipate the impact of the ball with the ground and to record the location at which the impact occurs. Tracking then continues until the ball's motion stops. Having properly recorded the desired aspects of a golf shot, the system is programmed to automatically reset to repeat its operation for the next golf shot originating from the same source. This information is transferred into the system control unit 82 where it may be accumulated, treated statistically, stored, and transmitted to the appropriate golfer through a local area network connecting to the golfer interface stations 90. Data may also be received into the system from other facilities for immediate utilization or for storage for later use. Typically, the data received would relate to a group of golf shots made at other locations or at other times and would be used for comparison to groups of golf shots made at the instant location. For instance, a comparison may be made of a golfer's performance at a particular target distance to the performance of a golf professional at the same distance. As each shot is hit, measurement is made, the statistics are updated for the total of the shots in the data set, and the results are immediately displayed back to the golfer at the teebox via the video control/display or golfer interface station. Programming allows for one or more players to occupy the teebox, so that if multiple players are selected on the setup, the display system will segregate performance by player in turn. This allows for the interesting and exciting capability of competition between golfers in their accuracy and consistency at hitting to specific targets, and creates one of the competitive forms of the game of Target Golf.

The treatment of the data relating to a golf shot includes a universally accepted set of mathematics, employing individual measurements and statistical computations such as averages, standard deviation, mode, etc. The results of these standard statistical formulae may be combined and/or treated numerically to derive a single score which defines the level of performance relative to other sets of data, and forms the basis for a competitive game. Because of its accuracy, the data generated by the present invention provides uniform basis that gives a level of measured relative performance, which now creates an exacting game from the activity of hitting balls at a target. The "game" may be played in solitaire, competing for comparison to one's personal previous performance, or against the measured and published performance of others such as club professionals or professional tour players. The "game" may also be played in direct "head to head" competition with one or more other golfers at the same location. Also, with networking of the data banks, competition with others at distant locations is possible. The Target Golf game encompasses all of these methods of comparative performance. The display of performance may be accessed in either tabular of graphical form, or in both forms, even simultaneously through use of the "split screen" technique. Following a session, a hard copy printout of graphical and/or tabular performance data may be obtained from a printer at the base location or other selected locations. Performance data for an individual golfer may be shown as tabulated or graphic data relating to impact and/or point of rest of the golf ball. Other forms of data presentation may be used to suit the needs and desires of the customer, so long as a relative measure of the desired aspects of performance are provided.

It is noteworthy that for any given shot, a comparison of impact location with an at rest location allows an analysis of an important consideration for skilled golfers, the degree to which his technique or equipment or combination of both enable him to stop a roll-out as his situation and choice may dictate. This is another unique capability of the golf ball tracking system and provides significant advantages over other inventions applied to golf performance measurement.

It is also the purpose of this invention to cover other related applications for the measurement process, as may be conceived for special applications and purposes. An example of a variation is the use of the system to view a target green and flag stick on a golf course where incoming balls may originate from various and random distances and locations. Programming will allow a similar determination of accuracy with standard deviations to be determined from these various ball origins. An example of this application might be for measurement and comparison for approach shots of professional golfers during tournament play, providing performance measurements of interest to television broadcast networks and to the spectators and viewing public.

In view of the above, it is clear that this golf ball tracking system may be programmed to allow a reconstruction of all or a selected portion of a golf shot from a tee to the point of impact and then on to the stopping point of the golf ball. While some applications require use of only a part of the capabilities of the system, the added information provided by full use of the available capabilities support the more demanding requirements such as total performance measurement to assist a professional golfer or golf instructor or an equipment manufacturer in the evaluation of both technique and equipment.

Obviously, numerous modifications and variations of the present invention are possible in light of the above teachings. It is therefore to be understood that within the scope of the appended claims, the invention may be practiced otherwise than as specifically described herein.

I claim:

1. A system for tracking, in three dimensions, the movement of at least two golf balls and for analysis of said movement of each said golf ball, said system comprising:

means including at least two strategically directed video cameras for locating and tracking, in three dimensions, the movement of said at least two golf balls and for providing video output signals indicative of the progressive positions of each said ball in response to said tracking;

display means for reception of said video output signals and for display of the resultant track of each said golf ball;

processing means for processing said video output signals; and storage means for storage of said processed video output signals.

2. A system as set forth in claim 1 further comprising control means for selective transmission of said processed video output signals.

3. A System as set forth in claim 2 in which said control means includes means which provide data to said display means for display of human readable indicia for indicating the track of each of said golf balls as provided by said processed video output signals.

4. A system for tracking, in three dimensions, the movement of at least one golf ball and for analysis of said movement of each said golf ball as said golf ball travels from a teebox area along a golf range, said system comprising:

at least one locator video camera positioned behind said teebox area and directed generally in the direction of movement of said golf ball;

at least one range video camera positioned adjacent said range, and directed generally perpendicularly to the direction of movement of each said golf ball;

each of said video cameras including means for producing imagery data indicative of the moving image of each said golf ball as said ball travels along said golf range; and image processing means for viewing, recording, and transmission of said imagery data indicative of the origin and selected aspects of the three dimensional movement of each said golf ball.

5. A system as set forth in claim further comprising a host processor having means for reception of said imagery data and for processing said imagery data so as to provide a history of the origin and movement of each said golf ball.

6. A system as set forth in claim 5 in which said host processor further includes:

recording means for recording performance data indicative of the movement of each said golf ball;

combining means for combining said performance data with the origin of each said golf ball; and statistic generating means for providing statistics and trends relating to the movement of each of said golf ball.

7. A system as set forth in claim 6 in which said host processor further includes at least one display means adapted to display selected data depicting the movement of each said golf ball.

8. A system as set forth in claim 7 in which at least one of said display means is positioned adjacent the origin of movement of each said golf ball and at least one additional location remote therefrom.

9. A system as set forth in claim 8 in which said host processor includes transmission means for transmission of said selected data to points outside said system.

10. A system as set forth in claim 9 in which said host processor further includes comparison means for comparison of data generated outside said system to data generated by said system and for display of said comparison by said display means.

* * * * *